US005874685A

United States Patent [19]

Ellis

[11] Patent Number: 5,874,685

[45] Date of Patent: Feb. 23, 1999

[54] REDUCTION OF LONGITUDINAL MODES IN MUSICAL INSTRUMENTS STRINGS

[76] Inventor: James F. Ellis, 102 Norton Rd., Oak Ridge, Tenn. 37830

[21] Appl. No.: 911,832

[22] Filed: Aug. 15, 1997

[51] Int. Cl.[6] ..... G10D 3/00

[52] U.S. Cl. ..... 84/297 S

[58] Field of Search ..... 89/297 S

[56] References Cited

U.S. PATENT DOCUMENTS

| | | |
|---|---|---|
| 904,325 | 11/1908 | Heffernan . |
| 1,603,676 | 1/1925 | Forster . |
| 1,794,190 | 2/1931 | Loman, Jr. . |
| 2,232,600 | 2/1941 | Fickenscher . |
| 3,523,480 | 8/1970 | Conklin, Jr. . |
| 4,055,038 | 10/1977 | Conklin, Jr. . |
| 5,585,582 | 12/1996 | Stanwood . |

OTHER PUBLICATIONS

Harold A. Conklin–*Design and tone in the mechanoacoustic piano*. Sep. 1996, *Acoustical Society of America*, pp. 1286–1297.

M. Podelsak and A.R. Lee–*Dispersion of waves in piano strings*. Jan. 1988, *Acoustical Society of America*, pp. 305–317.

Harold A. Conklin, Jr. –*Tuning the Longitudinal Mode of Piano strings*, Spring 1983, *Acoustical Society of America*, p.S84.

M. Podelsak–*Longitudinal vibrations in piano strings*, Spring 1987, *Acoustical Society of America*, p.S61.

A.F. Knoblaugh–*The Clang of Pianoforte*, Jul. 1944, *Acoustical Society of America*, p. 102.

*Primary Examiner*—William M. Shoop, Jr.
*Assistant Examiner*—Shih-Yung Hsieh

[57] ABSTRACT

This invention is directed towards a method of reducing longitudinal modes in vibrating strings of musical instruments having a plurality of strings of fixed lengths, such as pianos and harpsichords. The strings of musical instruments vibrate primarily in transverse modes, but longitudinal modes that are often inharmonious with the transverse modes can also be excited. The method of the present invention identifies those parameters of string vibration that excite longitudinal modes, and minimizes them by avoiding those combinations of parameters that excite them, including transverse frequency modes, longitudinal wave velocity, string length, and placement of the string-exciting device.

12 Claims, 1 Drawing Sheet

REDUCTION OF LONGITUDINAL MODES IN MUSICAL INSTRUMENTS STRINGS

TECHNICAL FIELD

This invention relates to the field of stringed musical instruments. More particularly, it relates to a method for reducing the longitudinal vibrations inherent in stringed instruments such as pianos and harpsichords.

BACKGROUND ART

Longitudinal vibrations of piano strings have been observed for at least seven decades, and perhaps longer. In an article about piano strings that appeared in the September 1996 issue of the JOURNAL OF THE ACOUSTICAL SOCIETY OF AMERICA, Harold A. Conklin, Jr. mentioned A. F. Knoblaugh's 1928 report about "wolftones" in some pianos that he (Knoblaugh) believed were caused by longitudinal vibrations. Knoblaugh never published his report, but he did present a paper about longitudinal vibrations at the 29th A.S.A. meeting (A. F. Knoblaugh, "The Clang Tone of the Pianoforte", JOURNAL OF THE ACOUSTICAL SOCIETY OF AMERICA, Vol. 16, P. 102 (1944).

On Aug. 11, 1970, Harold A. Conklin, Jr. was granted U.S. Pat. No. 3,523,480 for "Longitudinal Mode Tuning of Stringed Instruments". In 1983, Conklin published an article on the same subject in the JOURNAL OF THE ACOUSTICAL SOCIETY OF AMERICA (Supplement 1, Vol. 73).

An article by M. Podelsak and A. R. Lee that appeared in 1987 described the percussive excitation that was expected to produce longitudinal components as well as transverse vibrations, but offered little quantitative data (M. Podelsak and A. R. Lee, "Longitudinal Vibrations in Piano Strings", JOURNAL OF THE ACOUSTICAL SOCIETY OF AMERICA, Supplement 1, Vol. 81, 1987).

In another article the following year, Podelsak stated that the "percussive sound-pressure components of longitudinal string vibration origin masked strongly the initial sound development, and the effect of dispersion on the attack transient of the radiated sound could not be established" (M. Podelsak and A. R. Lee, "Dispersion of Waves in Piano Strings", JOURNAL OF THE ACOUSTICAL SOCIETY OF AMERICA, Vol. 83, PP. 305–317, 1988). Tuning longitudinal modes, as is done in the prior art, has definite merit, however, it does not address the origins of longitudinal modes that are preferable to eliminate or reduce than to merely tune. What is missing from the prior art is a method of reducing longitudinal modes in musical instrument strings.

SUMMARY OF THE INVENTION

My invention follows my discovery of the various inherent physical mechanisms that excite longitudinal modes in taut strings in addition to those described in the literature. It differs from the prior art by identifying combinations of parameters that exacerbate the excitation of longitudinal modes, and defines ways to avoid undesirable resonances between transverse and longitudinal modes.

Combinations of parameters marked for avoidance are those that would result in a fundamental longitudinal mode having a frequency approximating any value between the theoretical fifteenth harmonic of the fundamental transverse mode and the actual fifteenth partial of that mode. Other combinations of parameters marked for avoidance are those that would result in a fundamental longitudinal mode having a frequency approximating that of the fundamental of a transverse mode multiplied by an odd number, or approximating the sum of the frequencies of two consecutive transverse partials.

Additional combinations of parameters marked for avoidance are those that would result in a second-partial (full-wave) longitudinal mode having a frequency approximating the sum of two odd-numbered or two even-numbered transverse partials, or a third-partial longitudinal mode frequency approximating the sum of an odd-numbered and an even-numbered transverse partial.

Avoidance of the problem parameters is accomplished by modifying at least one parameter of the group, and thereby altering the combination. This may be done by modifying the length of the active portion of the string, the material, or the loading, or the location at which the string is excited.

BASIC PHYSICS BACKGROUND

Taut String Vibrations

The strings of musical instruments normally vibrate in a transverse mode in which the waves are perpendicular to the axis of the string and perpendicular to the direction of wave propagation. When a piano string is struck near one end by its hammer or a harpsichord string is plucked by its plectrum, a transverse wave is produced that propagates along the length of the string, reflecting from end to end until it finally disperses into discrete standing waves that make up the whole wave form of the tone of the note. If we assume that the string is completely flexible, having no springy stiffness of its own, this wave will move along the string at a velocity that can be expressed as $$V_t = k\sqrt{\frac{T}{m}} \tag{1}$$

where $V_t$ represents the propagation velocity of the transverse wave, k is a constant whose value depends upon the system of units used, T is tension, and m is mass per unit length. The fundamental transverse frequency of a taut string terminated at both ends is one half wavelength, and may be expressed as $$f_{t_1} = \frac{k}{2L_s}\sqrt{\frac{T}{m}} \tag{2}$$

where $\int_{t_1}$ represents the fundamental transverse frequency, and $L_s$ is the speaking length (length between terminations). Equations 1 and 2 show that the frequency of a transverse wave on a taut string is inversely proportional to its speaking length, proportional to the square root of tension, and inversely proportional to the square root of mass per unit length. In pianos and harpsichords, as in most stringed musical instruments, the frequencies of the transverse modes are tuned by adjusting tension.

When a string is struck or plucked near one end, the deflection that produces a transverse wave also produces a longitudinal wave because the instantaneous localized tension near the point of impact or sudden release (as in plucking) will be the vector sum of the static tension and the dynamic transverse force applied or released. This localized tensile anomaly then becomes a longitudinal wave that travels along the string at a velocity V, that can be expressed as:

$$V_l = k\sqrt{\frac{Y}{d}} \tag{3}$$

where Y is the Young's modulus of the string, and d is its density. The fundamental longitudinal frequency of a string terminated at both ends, being one half wavelength, can therefore be expressed as:

$$f_{l_1} = \frac{k}{2L_{se}} \sqrt{\frac{Y}{d}} \tag{4}$$

where $\int_{0_l}$ represents fundamental longitudinal frequency, and $L_{se}$ is the effective speaking length of the string in the longitudinal mode. Equations 3 and 4 indicate that the frequency of a longitudinal mode, like that of a transverse mode, is inversely proportional to length, but unlike that of a transverse mode, it is virtually insensitive to changes in tension. Instead, it is inversely proportional to the square root of density and proportional to the square root of the Young's modulus of the string. The frequencies of the longitudinal modes of the strings of a given instrument are virtually fixed by the scale design of that instrument, and can not be tuned in the usual manner by adjusting tension the way piano or harpsichord strings are normally tuned.

Harmonics, Overtones, and Partials

A clear understanding of the differences between harmonics, overtones, and partial tones is essential in order to understand the discussion and descriptions that follow. The transverse frequency of an actual string does not precisely follow the relationships shown in equation 2, which assume that the string has no internal stiffness of its own, but depends entirely upon tension to make it seek the shortest path between two points, i.e., a straight line. An actual string, however, particularly a piano string made of fairly heavy, high-tensile-strength steel wire, does have springy stiffness that introduces a very slight error in the calculation, and complicates what would otherwise be a fairly simple equation. This error that is introduced causes the frequency of the string to be very slightly higher than it would otherwise be, and the error increases as the number of standing waves on the string increases. As a result of this, the overtones of the normal (transverse) modes of struck or plucked strings, particularly those struck strings of modern pianos, are not truly harmonic. They closely approximate, but are not integral multiples of the fundamental frequency of the note, but nevertheless near enough to the theoretical harmonic frequencies to sound to the human ear as if they were.

The very slight deviation from the theoretical harmonic series that occurs in piano strings is referred to as "inharmonicity", and is well known to the designers of piano scales, and to most experienced piano tuners as well. The overtones of pianos are therefore referred to as "partial tones", or "partials", rather than as "harmonics". The first partial of a note is its fundamental frequency. The second partial has a frequency approximately twice that of the first; the third is approximately three times that of the first, etc. In referring to overtones, however, the first overtone is the second partial; the second overtone is the third partial, etc. The thin strings of harpsichords, in contrast to those of modern pianos, have only the slightest inharmonicity.

The amount by which the frequency of a given partial exceeds its true harmonic frequency increases as the number of the partial (in the series) increases. The frequency of a second partial may exceed twice that of the corresponding fundamental frequency by only a tiny fraction of a percent, but the frequency of a partial higher in the series may exceed that of its corresponding fundamental multiplied by its number in the series by several percentage points. For example, the frequency of the second partial of a certain note may exceed twice that of its corresponding fundamental by only the smallest fraction of a percent, but the frequency of its fifteenth partial may be several percentage points higher than its fundamental frequency multiplied by fifteen.

Longitudinal-Mode Observations

My invention is based upon the premise that tuning the longitudinal modes of musical instrument strings to selected intervals in their scales does not address those situations in which the excitation of a longitudinal mode should be avoided. The literature treats longitudinal modes as if they were simply caused by the percussion of the piano hammer. I have found that hammer percussion does excite longitudinal modes in strings, however, if this were the only means of their excitation, they would all decay rapidly in the same characteristic manner, but they do not do so.

By conducting carefully controlled experiments, I have discovered cases in modern pianos in which some longitudinal modes build up as a rapid crescendo following hammer impact, and reach full volume only after many cycles of the transverse mode have occurred. In these cases, the longitudinal modes continue for the duration of the whole tone, suggesting that energy is somehow being transferred from the transverse modes to the longitudinal modes long after the initial excitation at impact has passed. Not only do the inharmonious relationships between transverse modes and longitudinal modes change as the frequencies of the transverse modes are changed by tuning, but the intensity of the longitudinal modes also change dramatically. This supported my belief that some inherent mechanism of energy transfer existed that had not been previously identified. My invention details those combinations of parameters that excite longitudinal modes in taut strings, and discloses ways in which they can be avoided, as opposed to being tuned. These are defmed and explained in detail in the paragraphs that follow.

RESEARCH LEADING TO THE INVENTION

I began my studies of longitudinal modes in piano strings in 1979 although I had been aware of their existence long before that. I was aware of Conklin's patents (U.S. Pat. No. 3,532,480 for tuning the longitudinal mode, and U.S. Pat. No. 4,055,038 for a string-wrapping apparatus), but my primary goal was to identify what it was, besides the initial hammer impact, that excited those strident longitudinal modes. Of particular interest were those bizarre high-pitched ringing and rapidly pulsating sounds that appeared in certain plain (not wrapped) strings, particularly in the tenor sections of some pianos.

My original experiments were conducted using medium-sized grand pianos. These led to my first discovery of the physical parameters under which longitudinal modes are excited in piano strings, which in turn led to my first theories of their origins. I could not, however, rule out the possibility that some extraneous anomaly in some piano might be influencing the results. The objective of my experiments was to discover and identify those basic characteristics of string vibration that caused energy to be transferred from one mode to the other. In order to do that, it was necessary for me to construct a set of "clean" experiments that would be as free of extraneous effects as I could make them.

To accomplish my objective, I built a special monochord that could accommodate strings of various sizes and lengths, up to a maximum speaking length of 12 feet. The main body of this instrument was made of two heavy wooden beams laid parallel to each other, separated by 1.5 inch spacers, and securely bolted together at intervals along their lengths, with the bolts extending through the spacers. I constructed two identical string-attachment fixtures, one for each end of the string.

I provided each fixture with threaded studs and bars designed to clamp it securely to the parallel beams at any location along the length of the instrument. Each fixture comprised a steel plate fitted with a special bar clamp designed to provide a rigid, well defined termination for the string, a tuning device for tightening or loosening the string, and weights bolted to the sides of the plates to increase mass and damp out resonances. These identical string-terminating plates, one at each end of the string, which could be selectively located, allowed any chosen speaking length up to a maximum of 12 feet to be set up, and permitted the transverse mode of the string to be tuned at either end.

I constructed a fixture for carrying a light, spring-loaded piano hammer that could be positioned at any location along the length of the string. This hammer, when cocked and then released, provided blows of consistent intensity to simulate the striking of a string by its hammer in a piano.

I designed and constructed four electromagnetic sensors that could be placed above the string to detect and measure its transverse motions while being unresponsive to longitudinal motions or vibrations. I used one of these sensors to monitor transverse string vibration at the point of hammer impact, another to sense transverse string vibration at the midpoint, and another near the end of the string opposite the hammer.

The fourth transverse sensor was used in tuning the transverse frequency of the string. A similar unit, but one with larger pole pieces and a stronger magnetic field was connected to the mixed output of two tunable oscillators and used to continuously excite the test string in a variety of transverse modes during some of the experiments.

For exciting and sensing continuous longitudinal vibrations in the test string without touching it, I constructed two magnetostrictive transducers, one to be connected to an oscillator to function as a driver, and the other to function as a sensor. Magnetostriction is that property of a ferromagnetic material that causes it to contract in the presence of a magnetic field. When an alternating current is sent through a coil of wire that encircles a ferromagnetic rod in the presence of a magnetic field parallel to the rod, longitudinal vibrations at the frequency of the alternating current will be excited in the rod. Conversely, when a ferromagnetic rod encircled by a coil of wire in the presence of a magnetic field is vibrating in a longitudinal mode, an alternating current at the frequency of the longitudinal vibration will be induced in the coil. In my experiments, the test string, a taut piano wire, represented the ferromagnetic "rod".

The transducers that I constructed, both drivers and sensors, were used in conjunction with an assortment of oscillators, amplifiers, oscilloscopes, counters and a data recorder. This apparatus enabled me to accurately measure the longitudinal wave velocity in different samples of music wire from different manufacturers, as well as to allow me to observe, record, and analyze a variety of interesting wave forms. My following statements regarding the excitation of longitudinal modes in strings are the culmination of the experiments I conducted.

LONGITUDINAL MODE EXCITATION IN TAUT STRINGS

1. The angular deflection of a taut string resulting from a blow or a pluck will alter the tension of the string in the region of the deflection and initiate longitudinal vibrations (in addition to transverse vibrations) that will decay in a characteristic manner following the initial event if no other energy is imparted to the longitudinal mode of vibration.

2. A transverse-mode pulse traveling from end to end along a taut string will impart energy to longitudinal-mode vibrations of that string when an odd numbered multiple of the frequency of the pulse (defined as the number of round-trip passes per unit time) is resonant with the natural frequency of the longitudinal mode, and will cause the longitudinal vibrations to increase following the initial event that caused the transverse pulse.

3. Transverse vibrations of a taut string will excite longitudinal vibrations of that string when the sum of the frequencies of an odd-numbered and an even-numbered transverse partial is resonant with the natural frequency of the fundamental longitudinal mode, or an odd-numbered multiple thereof. The greatest amount of energy will be transferred from transverse modes to longitudinal modes when the transverse partials occur consecutively in the harmonic series.

4. Transverse vibrations of a taut string will excite longitudinal vibrations of that string when the sum of the frequencies of two odd-numbered transverse partials or two even-numbered transverse partials is resonant with the frequency of an even multiple of the fundamental longitudinal frequency. The greatest energy transfer will occur when the two odd plus odd, or even plus even, transverse partials occur sequentially in the harmonic series with one partial of the opposite sign separating them.

5. When conditions are set up according to #3 or #4 above, energy can be transferred from the longitudinal mode to the two specified transverse partials (odd+even, odd+odd, even+even) that lie nearest to each other in the harmonic series.

DESCRIPTION OF THE PROBLEM TO BE SOLVED

Modern keyboard instruments are designed with twelve notes to the octave that are tuned in twelve steps with each ascending note increasing in frequency by the 12th root of 2 from that of the previous note. For example, the fundamental of the note A of the fourth octave is normally tuned to a frequency of 440 Hz, and each ascending chromatic note is tuned to a frequency of the preceding note multiplied by approximately 1.059463094, so that the fundamental frequency of note A of the fifth octave will be 880 Hz, if inharmonicity be neglected. Each chromatic note in the descending scale, therefore, is the frequency of the note above divided by approximately 1.059463094, if inharmonicity be neglected. In the modern "Equal Temperament", this pattern of tuning is followed throughout the scale, except for the slight compensations made to accommodate inharmonicity.

As previously stated, the transverse-mode frequency of taut strings is inversely proportional to length. To conserve space, however, it is common practice to design piano scales so that the speaking lengths of the strings of successive lower notes are slightly shorter than the inverse relationship of length to frequency would indicate. For example, the speaking length of an A-3 string would be slightly less than twice the speaking length of an A-4 string. To compensate for this shortening of ideal length, the mass per unit length of the descending strings of the scale is made progressively greater in order to maintain even tension. In the lower bass section of pianos, this increase in mass per unit length is accomplished by wrapping the strings with copper wire to add mass without unduly increasing stiffness. In the tenor and treble, however, it is simply done by increasing the diameter of the strings in the descending scale.

As was also stated previously, the longitudinal-mode frequency of a string is virtually insensitive to changes in tension. Instead, it is dependent upon the density and Young's modulus of the wire, which determine the longitudinal wave velocity along the axis of the string. If the lengths of the plain strings of a given material (steel for piano strings) do not conform to the inverse length-to-frequency rule, then the ratios of longitudinal-to-transverse frequencies will change progressively by small increments in the strings of each ascending or descending note in the scale. Therefore, somewhere in the scale, usually in the tenor section of a piano where most of the plain-wire speaking-lengths are traditionally shortened, a resonance between some transverse mode and some longitudinal mode is likely to occur that will excite that longitudinal mode to a far greater intensity than it would otherwise be excited. The result is the production of high-pitched, inharmonious, and sometimes bizarre sounds that appear in certain notes of an instrument while being absent in other nearby notes.

The prior art (Conklin, U.S. Pat. No. 3,523,480) describes methods for tuning the fundamental longitudinal mode to frequencies corresponding to "flexural" (transverse) mode intervals and to frequencies corresponding to those of the notes of the stretched equally tempered scale. By contrast, my discovery identifies those parameters that are responsible for exciting not only the fundamental longitudinal mode, but other longitudinal modes as well, and my invention defines design criteria to be used to minimize the excitation of those longitudinal modes that sometimes stand out disproportionately and are tonally dissonant and objectionable.

For scale-design purposes related to longitudinal modes, it is necessary to know the longitudinal wave velocity along the axis of the string. I have observed that different makes of music wire, often made by processes that include some proprietary procedures known only to the manufacturers, do not all exhibit exactly the same longitudinal wave velocity.

Indeed, all of the samples of music wire that I have tested have had longitudinal wave velocities that fall within the published range of values, but they nevertheless have had sufficient differences to make it impractical to design a scale in which the fundamental longitudinal mode will always be in tune with some frequency of the transverse mode, even though the instrument may be kept tuned to standard pitch. I have also observed that the fundamental is not the only longitudinal mode that causes undesirable sounds in pianos. In this regard, the second partial of the longitudinal mode is a frequent offender, and sometimes even the third longitudinal partial can be heard in large grand pianos having long strings.

It is therefore an object of the present invention to provide scaling criteria for stringed musical instruments that avoid resonances between transverse modes and longitudinal modes.

Another objective of the invention is to provide strings having an altered longitudinal wave velocity to be used in strategic locations of the scale of a musical instrument to avoid undesirable resonances between transverse modes and longitudinal modes.

Still another objective of the invention is to provide criteria for the location of hammers or plectra in musical instruments that will avoid the excitation of certain partials of the transverse mode that have been found to be critical to the excitation of certain undesirable longitudinal modes.

Other objects and advantages over the prior art will become apparent to those skilled in the art upon reading the detailed description together with the drawings as described as follows.

DISCLOSURE OF THE INVENTION

While the mechanism by which a sudden deflection or release of a taut string will initiate longitudinal waves may be found in the known art, as discussed above in Item 1 under LONGITUDINAL MODE EXCITATION IN TAUT STRINGS), Items 2 through 5 derive from my experiments previously mentioned, and to the best of my knowledge, do not appear in the previously known literature.

Immediately following impact by a hammer near one end of a string in a piano, or plucking by a quill or plectrum in a harpsichord, a pure fundamental tone of the note is absent. Instead, all of the component frequencies of the whole tone are contained in a complex pulse-like wave that travels from end to end along the string, reflecting from one end to the other, over and over again, until it finally disperses into the discrete transverse standing waves that make up the timbre of the note, and persist for its duration. As explained above, when the string is struck or plucked near one end, the vector sum of forces produces a longitudinal as well as a transverse wave. When the complex transverse pulse reaches the termination at the opposite end of the string, it is reflected back inverted. A virtual inverted image of the initiation of the pulse occurs during the first reflection, and each following reflection is an inverted image of the previous reflection. This process continues until the transverse pulse has dispersed into discrete standing waves. A virtual image of the force vectors that initiated the longitudinal wave is repeated each time the transverse pulse is reflected, inverting at each reflection. If each reflection of this transverse pulse happens to be in phase with a reflection of the longitudinal wave, the vector sum of forces during each reflection will cause the transverse pulse to give up some of its energy to the longitudinal wave, causing the longitudinal mode to build up and the transverse mode to decay more rapidly than it otherwise would. The relative tuning between transverse and longitudinal modes required to make this happen is critical. The very slightest relative detuning of the two modes will cause this energy transfer to disappear.

I have proven that if the fundamental longitudinal frequency of the string is an odd multiple of the transverse mode fundamental (defined as the number of round trips of the transverse pulse per unit time), the reflections of the transverse pulse and the longitudinal wave will remain in phase as long as the traveling transverse wave persists, or until it disperses into discrete standing waves. However, if the fundamental longitudinal frequency is an even multiple of the transverse-pulse round-trip frequency, the transverse and the longitudinal reflections will be in phase at one end of the string, but out of phase at the other end, causing the would-be build-up of the fundamental longitudinal wave to cancel. On the other hand, when the longitudinal mode frequency is at its second partial (one full wavelength) with a node in the center of the string, it will build up when it is an even multiple of the transverse pulse frequency, but cancel when it is an odd multiple of the same.

The mechanism by which the phenomenon of odd-plus-even transverse partials excites the fundamental longitudinal mode is that of interference. As the string vibrates, the two consecutive transverse partials beat against each other at the approximate frequency of the transverse fundamental. When consecutively occurring odd plus even, or even plus odd (the order does not matter) transverse partials are in phase at one end of the string, they will be out of phase at the opposite end. The in-phase transverse partials cause increased standing waves at one end of the string, but the out-of-phase transverse partials cancel and result in decreased standing waves at the opposite end. The increased standing waves result in increased deflection and therefore increased tension, pulling the string in that direction; but the decreased standing waves at the opposite end virtually cancel the string deflection resulting from those partials, thereby reducing tension and allowing the string to be pulled in the other direction. When the fundamental longitudinal frequency is equal to the sum of the two consecutive partials, it will be an integral multiple of the beating rate of the partials, and coincident with the peak of the partial beating, regardless of the end where the peak occurs. When these conditions exist, the fundamental longitudinal mode will approximate an odd multiple of the fundamental transverse mode, but it will be very slightly in excess of that value due to inharmonicity. The string is literally pulled from end to end by increased tension at one end while the tension is decreased at the other end, and these events will coincide with the phase of the longitudinal mode.

The sum of two consecutive transverse partials is not likely to approximate the frequency of a fundamental longitudinal mode that approximates an even multiple of the transverse fundamental frequency unless the inharmonicity of the scale is far greater than that which is considered acceptable. It is therefore not considered here.

This phenomenon, this combination of physical mechanisms that excite first, second, third, and higher partials of the longitudinal mode are all similar, but the ones that excite the higher orders are more complex. The principles are the same. They are those of interference and augmentation that coincide with the phase of the longitudinal mode to cause it to build up following the initial excitation of the string. When these conditions do not exist, the decay of the longitudinal mode is rapid.

All of the foregoing theories have been proven by my experiments using the apparatus described previously. For verification in some cases, the string was excited in one of the longitudinal modes described, and as a result, the two consecutive transverse partials whose sum of frequencies were equal to the longitudinal mode frequency appeared, thus proving that the energy would transfer in either direction.

BEST MODE FOR CARRYING OUT THE INVENTION

Figure 1:
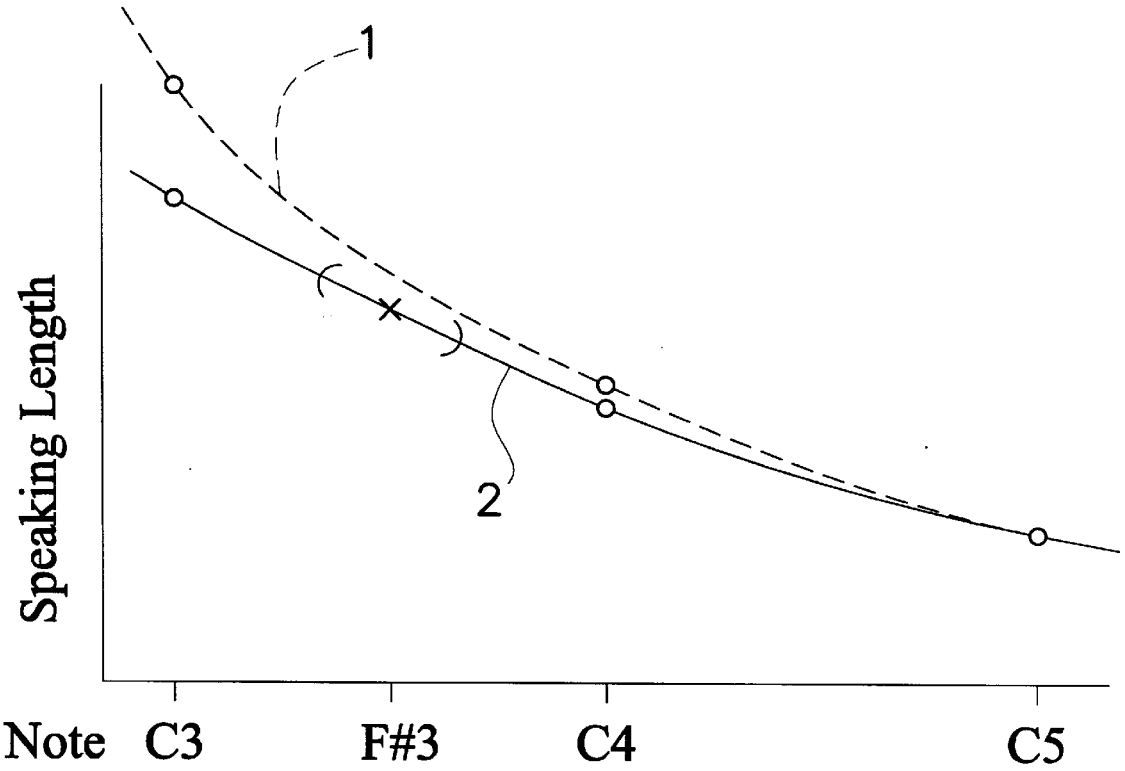
FIG. 1 illustrates a plot showing a two-octave segment of the scale of a typical piano. The broken line (1) represents an ideal length-to-pitch ratio, and the solid line (2) represents this ratio as it might appear in a typical piano.

A method for reducing longitudinal modes in stringed musical instruments having embodiments in accordance with the present invention, is discussed herein. The foregoing sets of parameters are first approximated by calculation in the early stages of the design of a new instrument, and later refined and proven in the prototype development. Any of the identified parameters that will combine to result in the fundamental longitudinal mode of a string having a frequency occurring at any value between the theoretical fifteenth harmonic and the actual fifteenth partial of the transverse mode of the string are identified as conditions to be avoided.

Other parameters to be avoided are those that would produce fundamental longitudinal modes whose frequencies would be resonant with the sum of any pair of consecutive odd plus even, or even plus odd partials of the transverse mode, or any odd multiple of the fundamental transverse mode. Still other parameters to be avoided are those that would produce second-partial longitudinal modes resonant with any sequential pair of odd plus odd, or even plus even partials of the transverse mode.

And finally, the third-partial longitudinal mode, or one being three half wavelengths, is the highest order of concern here. It can be minimized by avoiding combinations of consecutive transverse partials, the sum of whose frequencies approximates that of the third-partial longitudinal mode of concern. Longitudinal partials of higher order are theoretically possible to excite, but unlikely to occur in modern pianos or harpsichords.

Although the longitudinal wave velocity in music wire is virtually insensitive to changes in tension, there does appear to be a very slight negative relationship between tension and velocity. Therefore, when the longitudinal wave velocity of a sample of wire is measured for scale-design purposes, it should be measured with the wire at design tension.

The relationship between frequency, velocity, and wavelength is $$V=n\lambda \tag{5}$$

where V represents velocity, n is the number of cycles per unit time, and $\lambda$ is the wavelength. When employing my invention in the scale design of an instrument, the approximate speaking lengths of the strings are determined by conventional scale-design methods. If the speaking lengths of any strings be such that any of their longitudinal modes would resonate with any of the transverse modes in a manner described above, those speaking lengths are either altered sufficiently to avoid the resonance, or a wire having a different longitudinal wave velocity is used, or both. In addition, the strike points of piano hammers or the plucking positions of harpsichord plectra may be adjusted to avoid the excitation of transverse modes that would be critical to the excitation of the undesirable longitudinal mode.

I have observed, as did Conklin (U.S. Pat. No. 3,523,480), that the length that determines the longitudinal mode frequency of a given string is slightly greater than the actual speaking length of the string. However, my findings differ slightly from those of Conklin. I have observed that this additional length is neither a finite quantity nor a fixed percentage of the speaking length of the string. Rather, it appears to depend upon many factors, including the combined lengths of the nearby tails (length of wire between the bridge and the rear hitch pin), whether or not the instrument has a duplex bar behind the bridge, the angle at which the string crosses the bridge, the proximity of the string to the end of the bridge, and the height, mass, and compliance of the bridge parallel to the plane of the strings. Due to this combination of factors, some of which may be unknown, it is impractical to accurately calculate the effective length of a given string's longitudinal mode or the frequency of that mode. However, that additional length beyond the physical speaking length can be estimated to a close approximation. I have not determined the effect, if there be any, of the length of the string between the tuning pin and the first termination (agraffe or capo bar), and therefore I have omitted it from the approximations. According to my measurements, the effective length of the fundamental longitudinal mode approximates that of the physical speaking length (length between agraffe and bridge) plus a correction factor of 10 percent of the average tail lengths of strings not near the end of the bridge. This "correction factor" added to the physical speaking length for determining the effective longitudinal speaking length may rise to 20 percent of the tail lengths for strings that cross the bridge near its end, and it may become even more if the bridge rises relatively high above the soundboard. Where the bridge does not rise high above the soundboard, and the strings cross at a very acute angle, this correction factor may decrease to about six percent of the tail length, or even less. When the longitudinal wave velocity and effective speaking length are known, the frequency of the fundamental longitudinal mode can be expressed as:

$$f_{l_1} = \frac{V_l}{2L_{se}} \tag{6}$$

where $\int_{0_1}$ represents fundamental longitudinal frequency, $V_l$ is the measured longitudinal wave velocity, and $L_{se}$ is effective longitudinal speaking length. Because the longitudinal speaking length is somewhat longer than the actual string length between terminations, $L_{se}$ becomes $L_s$ plus correction factor c, therefore the approximate frequency of the fundamental longitudinal mode now becomes:

$$f_{l_1} \cong \frac{V_l}{2(L_s + c)} \tag{7}$$

where $L_s$ is the speaking length (measured between terminations) and c is the correction factor.

In the longer strings of the tenor and bass of large grand pianos, where the excitation of second or third partial longitudinal modes might be a concern, it should be remembered that the second partial is one fall wavelength, with one intermediate node, and the third longitudinal partial is three half wavelengths, with two intermediate nodes. The approximations can be modified to accommodate each of these cases. The frequency of the second partial of the longitudinal mode then becomes:

$$f_{l_2} \cong \frac{V_l}{L_s + c} \tag{8}$$

where $\int_{0_2}$ represents the second partial of the longitudinal mode. Because the third partial is three half-wavelengths, that partial of the longitudinal mode can be approximated as:

$$f_{l_3} \cong \frac{3V_l}{2(L_s + c)} \tag{9}$$

where $\int_{0_3}$ represents the longitudinal third partial. While these approximations can bring the design parameters close to the optimum, the final determinations should nevertheless be made by empirical methods.

Locating a piano hammer so that it will strike the string at a node of one of the transverse partials that has been found to contribute to the excitation of a longitudinal mode will reduce that longitudinal-mode excitation. The same principle holds true for the location of a harpsichord plectrum. For example, if the sum of the eighth and ninth transverse partials excites a fundamental longitudinal mode in the string of a piano, then the placement of the hammer so that it will strike the string at one eighth of its speaking length from the front termination will virtually eliminate the eighth transverse partial by striking at its first node. One transverse partial of the pair necessary to excite the longitudinal mode will therefore be missing. Similarly, if the hammer be made to strike at one ninth of the string length from a termination, it will be striking at a node of the ninth partial, and thereby eliminate it, eliminating one partial of the combination.

The location of a piano hammer or harpsichord plectrum at the node of one of a pair of transverse partials that act together to excite a longitudinal mode does not completely eliminate that longitudinal mode. A pair of odd and even partials will remain (one above and one below the consecutive pair), and the sum of their frequencies will also result in excitation of the longitudinal mode, but to a lesser degree than would that of the consecutive pair.

The most frequently occurring and most troublesome of the various longitudinal resonances that I have found occurs when the fundamental longitudinal frequency lies somewhere between the fundamental transverse frequency multiplied by fifteen, and the fifteenth actual partial of the transverse mode. Within this range, the transverse pulse reflections following string excitation, the sum of the seventh and eighth transverse partials, the third harmonic of the fifth transverse partial, and the fifth harmonic of the third transverse partial will all be near enough to the same frequency to combine in exciting the longitudinal mode in an extremely dissonant, high pitched, even bizarre manner to produce sounds very displeasing to the trained ear. I have encountered this problem numerous times in the tenor sections of otherwise fine pianos, and there is no voicing technique that will eliminate it.

Referring again to the drawings, FIG. 1 is a plot showing a two-octave segment of the string-length scaling in a typical piano having shortened tenor strings. The upper broken-line trace (1) represents an ideal scaling in which the speaking lengths of the strings of each descending octave are twice that of the octave above. The lower solid-line trace (2) represents the speaking-length scaling of a typical piano having shortened tenor strings. The speaking length represented by the (X) inside the parentheses is that which would establish those parameters critical to the excitation of an undesirable longitudinal mode. Strings on either side of the string (note F#3 in this illustration) that is centered in the resonance pattern will also be affected, as indicated by the parentheses, but not to the same extent as the string that is centered at the peak of the resonance. Although note F#3 is used to illustrate the note where maximum resonance occurs, it can occur at any location in the scale, depending upon the scaling of the instrument.

Figure 2:
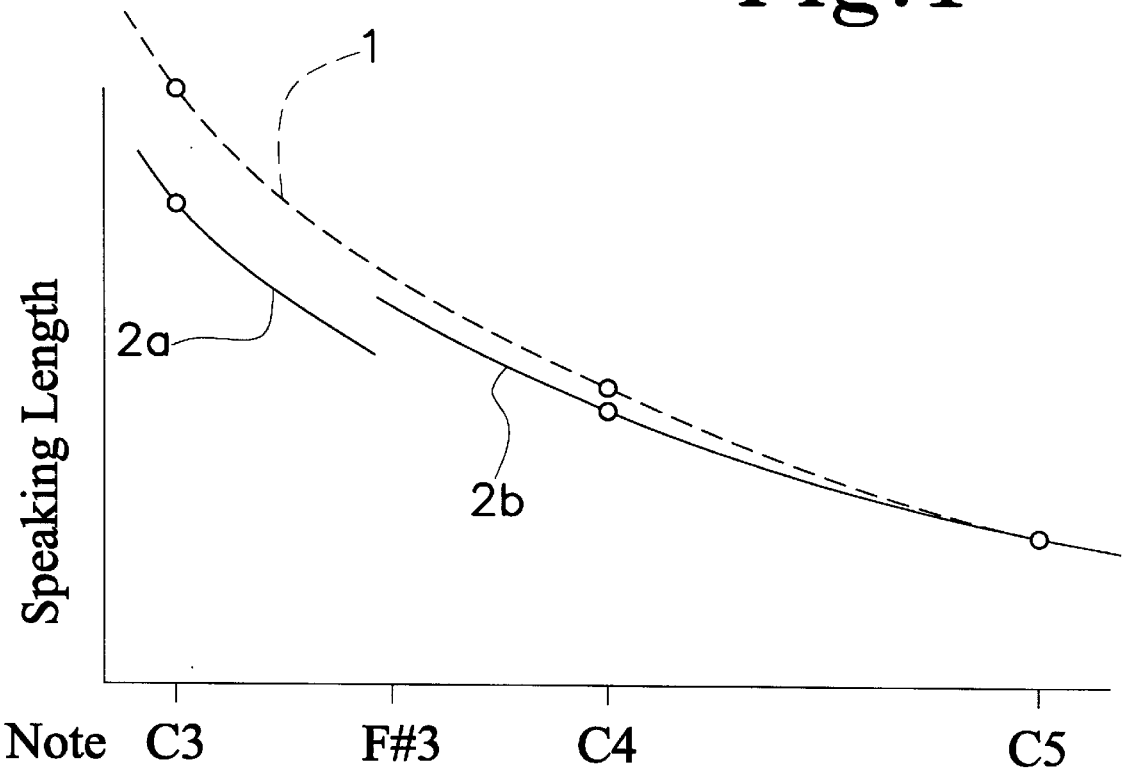
FIG. 2 is a plot in which broken line (1) represents the same ideal length-to-pitch ratio in a similar piano, but in this case, the actual scaling represented by solid line segments **(2*a*) and (2*b*) offset avoids the coincidence that will cause a resonance that is represented by the (X) on the solid line in FIG. 1**. This will be more fully explained in the paragraphs that follow.

FIG. 2 is a plot showing a special case in which the resonance parameters have been avoided. The upper broken line (1) represents an ideal speaking-length plot covering a two-octave segment from notes C3 to C5. The lower solid lines 2*a* and 2*b* represent the speaking length in the tenor section of a piano in which the resonance between transverse and longitudinal modes has been avoided by an offset occurring between notes F3 and F#3. The lower end of line 2*a* illustrates strings whose speaking lengths have been shortened to cause their longitudinal mode frequencies to be just above resonance, while the upper end of line 2*b* indicates speaking lengths just long enough to cause the longitudinal mode to be below resonance with the transverse modes. It should be understood that these plots illustrate a typical location in the scale where a resonance may occur. It can also occur elsewhere, and is not limited to this region of the scale.

From the foregoing description, it will be recognized by those skilled in the art that a method of reducing longitudinal modes, as opposed by simply tuning the longitudinal modes, offering advantages over the prior art has been provided. Specifically, the method provides scaling criteria for stringed musical instruments that avoid resonances between transverse modes and longitudinal modes. Further, the method provides for altering the longitudinal wave velocity of strings in strategic locations of the scale of a musical instrument to avoid undesirable resonances between transverse modes and longitudinal modes. Still further, the method of the present invention provides criteria for the location of hammers or plectra in musical instruments that will avoid the excitation of certain partials of the transverse mode that have been found to be critical to the excitation of certain undesirable longitudinal modes.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A method for reducing longitudinal modes in a musical instrument having a plurality of strings arranged in a scale of graduated fixed lengths, each string tuned to a predetermined transverse-mode frequency by adjustment of tension and excited by impingement at a designated location, said method comprising the steps:

identifying in any region of said scale a frequency band within which any string would exhibit a resonance between a transverse mode and a fundamental longitudinal mode, the lower boundary of said frequency band being the theoretical fifteenth harmonic of said transverse mode and the upper boundary of said frequency band being the actual fifteenth partial of said transverse mode;

identifying in said string a combination of physical parameters comprising effective longitudinal-mode speaking length and longitudinal wave velocity that would cause the natural frequency of said fundamental longitudinal mode to fall within said frequency band; and altering at least one of said physical parameters thereby shifting said natural frequency of said fundamental longitudinal mode away from said frequency band and avoiding said resonance.

2. The method defined in claim 1 therein said at least one of said physical parameters is effective longitudinal-mode speaking length.

3. The method defined in claim 1 wherein said altering at least one of said physical parameters is the introduction of an offset in said region of said scale causing said effective longitudinal-mode speaking length in the upper portion of said region to be lengthened, and causing said effective longitudinal-mode speaking length in the lower portion of said region to be shortened, thereby causing said natural frequency of said fundamental longitudinal mode to fall below said resonance in those strings just above said offset and above said resonance in those strings just below said offset.

4. The method defined in claim 1 wherein said at least one of said physical parameters is longitudinal wave velocity.

5. A method for reducing longitudinal modes in a musical instrument having a plurality of strings arranged in a scale of graduated fixed lengths, each string tuned to a predetermined transverse-mode frequency by adjustment of tension and excited by impingement at a designated location, said method comprising the steps:

identifying in any region of said scale a certain frequency at which any string would exhibit a resonance between complex transverse modes and an odd-numbered multiple of the natural frequency of a longitudinal mode including the first, said certain frequency being equal to the sum of the frequencies of two transverse partials occurring in consecutive order in the harmonic series, one of said transverse partials being even-numbered in said harmonic series and the other said transverse partial being odd-numbered in said harmonic series;

identifying in said string a combination of physical parameters comprising effective longitudinal-mode speaking length and longitudinal wave velocity sufficient to cause said natural frequency of said longitudinal mode to approximate said certain frequency, said combination of physical parameters also comprising the location of said impingement; and altering at least one of said physical parameters thereby avoiding said resonance.

6. The method defined in claim 5 wherein said at least one of said physical parameters is effective longitudinal-mode speaking length.

7. The method defined in claim 5 wherein said at least one of said physical parameters is longitudinal wave velocity.

8. The method defined in claim 5 wherein said altering at least one of said physical parameters is the introduction of an offset in said region of said scale causing said effective longitudinal-mode speaking length in the upper portion of said region to be lengthened, and causing said effective longitudinal-mode speaking length in the lower portion of said region to be shortened, thereby causing said natural frequency of said fundamental longitudinal mode to fall below said resonance in those strings just above said offset and above said resonance in those strings just below said offset.

9. The method defined in claim 5 wherein said at least one of said physical parameters is said location of said impingement and wherein said altering is accomplished by relocating said impingement at one of the nodes of one of said two transverse partials, thereby silencing that partial.

10. A method for reducing longitudinal modes in a musical instrument having a plurality of strings arranged in a scale of graduated fixed lengths, each string tuned to a predetermined transverse-mode frequency by adjustment of tension and excited by impingement at a designated location, said method comprising the steps:

identifying in any region of said scale a certain frequency at which any string would exhibit a resonance between complex transverse modes and an even-numbered multiple of the natural frequency of a longitudinal mode, said certain frequency being equal to the sum of the frequencies of two transverse partials occurring in sequence in the harmonic series but separated by one transverse partial in said harmonic series;

identifying in said string a combination of physical parameters comprising effective longitudinal-mode speaking length and longitudinal wave velocity sufficient to cause said even-numbered multiple of said natural frequency of said longitudinal mode to approximate said certain frequency, said combination of physical parameters also comprising the location of said impingement; and altering at least one of said physical parameters thereby avoiding said resonance.

11. The method defined in claim 10 wherein said at least one of said physical parameters is longitudinal wave velocity.

12. The method defined in claim 10 wherein said at least one of said physical parameters is said location of said impingement and wherein said altering is the relocation of said impingement to one of the nodes of one of said two transverse partials, thereby silencing that partial.

* * * * *